US007955109B2

(12) United States Patent
Toner

(10) Patent No.: US 7,955,109 B2
(45) Date of Patent: Jun. 7, 2011

(54) QUICK DISCONNECT HERMAPHRODITIC ELECTRICAL CONNECTOR WITH SHARP ANGLE INTERLOCKING SIDE HOOKS ON EACH HALF

(76) Inventor: William M. Toner, Castroville, TX (US)

( * ) Notice: Subject to any disclaimer, the term of this patent is extended or adjusted under 35 U.S.C. 154(b) by 0 days.

(21) Appl. No.: 12/692,565

(22) Filed: Jan. 22, 2010

(65) Prior Publication Data

US 2011/0028016 A1 Feb. 3, 2011

Related U.S. Application Data

(60) Provisional application No. 61/146,601, filed on Jan. 22, 2009.

(51) Int. Cl.
*H01R 13/28* (2006.01)

(52) U.S. Cl. ..... 439/284

(58) Field of Classification Search ..... 439/284, 439/292, 290, 291, 295, 460
See application file for complete search history.

(56) References Cited

U.S. PATENT DOCUMENTS 2,591,437 A * 4/1952 Jun ..... 439/290
4,737,118 A * 4/1988 Lockard ..... 439/295
5,259,780 A * 11/1993 Morrissey et al. ..... 439/292
5,800,196 A * 9/1998 Rudoy et al. ..... 439/284

* cited by examiner

*Primary Examiner* — Chandrika Prasad
(74) *Attorney, Agent, or Firm* — Kammer Browning PLLC

(57) ABSTRACT

A number of improved interlock structures on a quick disconnect hermaphroditic electrical connector that specifically improve the keyed alignment of the two connector ends when joined together as well as the security of the connection. The combination of a "top closed" interlock insert depression and a pair of interlock disc projections provides for better keyed alignment and a more secure connection. The use of sharp angle interlock side hooks further provides for a more secure connection.

1 Claim, 2 Drawing Sheets

QUICK DISCONNECT HERMAPHRODITIC ELECTRICAL CONNECTOR WITH SHARP ANGLE INTERLOCKING SIDE HOOKS ON EACH HALF

CROSS REFERENCES TO RELATED APPLICATIONS

This application claims the benefit under Title 35 United States Code §119(e) of U.S. Provisional Application 61/146,601 filed Jan. 22, 2009 the full disclosure of which is incorporated herein by reference.

BACKGROUND OF THE INVENTION

1. Field of the Invention

The present invention relates generally to electrical connectors. The present invention relates more specifically to improvements for increasing the electrical contact compliance between two identical (hermaphroditic) connector halves.

2. Description of the Related Art

The present invention provides specific and highly advantageous improvements to the device generally disclosed and described in U.S. Pat. No. 5,259,780; issued Nov. 9, 1993; to Morrissey, III et al.; entitled Quick Disconnect Wiring Connector, the full disclosure of which is incorporated herein by reference. The present invention provides alternate structures to those described and claimed in the Morrissey, III et al. reference and as such provide an improved quick disconnect hermaphroditic electrical connector. The structure of the present invention improves upon the keyed alignment of the two connector ends when joined together and further improves on the security of the connection both incrementally and over repeated connections and disconnections.

SUMMARY OF THE INVENTION

The present invention provides for improved interlock structures on a quick disconnect hermaphroditic electrical connector that specifically improve the keyed alignment of the two connector ends when joined together and the security of the connection. The combination of a "top closed" interlock insert depression and a pair of interlock disc projections provides for better keyed alignment and a more secure connection. The use of sharp angle interlock side hooks provides for a more secure connection.

DETAILED DESCRIPTION OF THE PREFERRED EMBODIMENTS

Figure 1:
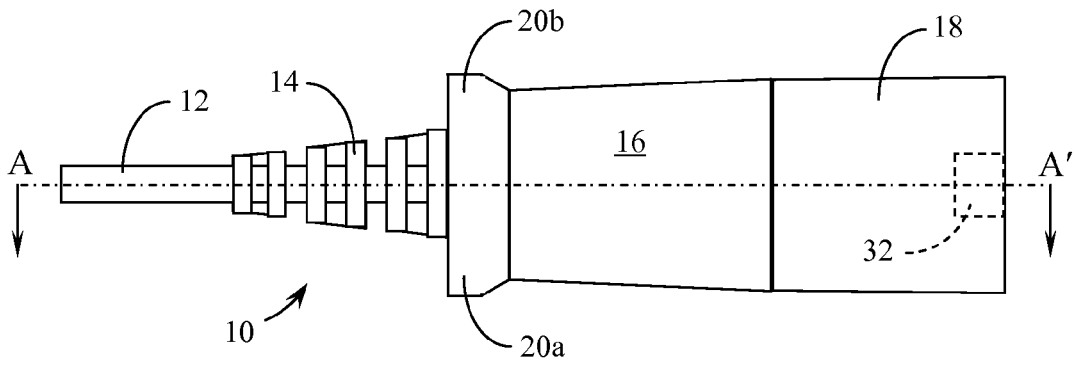
FIG. 1 is a top plan view of a connector half according to the present invention.

The Drawings appended hereto include all of the various views of the connector of the present invention and include the following referenced components:

10 Quick disconnect (QD) wiring connector.
12 Electrical multi-conductor cable.
14 Strain relief collar.
16 Connector half block.
18 Connector half interface.
20*a* & 20*b* Connector finger grips.
22 Electrical conductor pads support base.
24 Interconnect conductor shroud.
26*a* & 26*d* Electrical contact pins.
28*a* & 28*b* Interlock disc projections.
30*a* & 30*b* Interlock side hooks.
32 Interlock insert depression.
34*a* First connector half
34*b* Second connector half Reference is made first to FIG. 1 for a top plan view of a connector half according to the present invention. In this view are shown quick disconnect (QD) wiring connector 10 having electrical multi-conductor cable 12, strain relief collar 14, connector half block 16, connector half interface 18, and connector finger grips 20*a* & 20*b*. Also shown in this view is the "top covered" interlock insert depression 32 shown in dashed outline as hidden on the underside of the outer surface of connector half interface 18.

Figure 2:
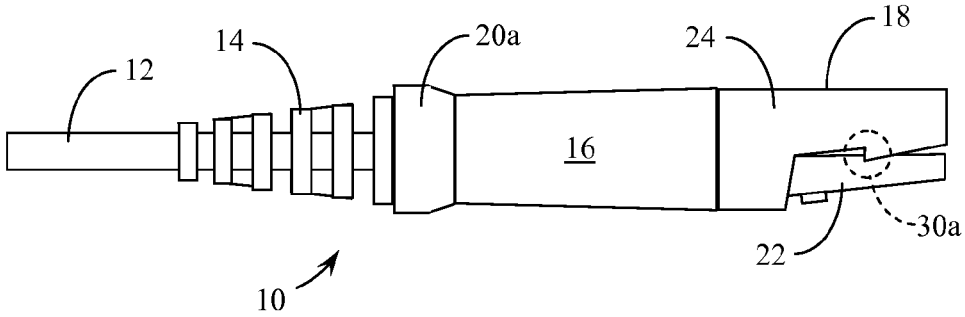
FIG. 2 is a side plan view of the connector half of the present invention.

FIG. 2 is a side plan view of the connector half of the present invention shown in FIG. 1. In this side view are shown quick disconnect (QD) wiring connector 10 having electrical multi-conductor cable 12, strain relief collar 14, connector half block 16, connector half interface 18, and connector finger grip 20*a*. Also shown in this side view is electrical conductor pads support base 22 and interconnect conductor shroud 24. Parts of the structure of shroud 24 are interlock side hooks 30*a* & 30*b* (the latter shown in FIG. 5). the "top covered" interlock insert depression 32 shown in dashed outline as hidden on the underside of the outer surface of connector half interface 18.

Figure 3:
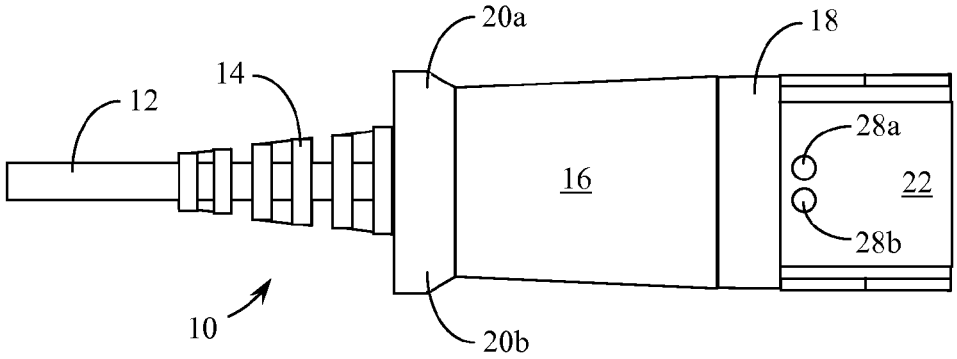
FIG. 3 is a bottom plan view of the connector half according to the present invention

FIG. 3 is a bottom plan view of the connector half according to the present invention. In this view are shown quick disconnect (QD) wiring connector 10 having electrical multi-conductor cable 12, strain relief collar 14, connector half block 16, connector half interface 18, and connector finger grips 20*a* & 20*b*. Also shown in this view is electrical conductor pads support base 22 and as positioned on the outer surface of support base 22, interlock disc projections 28*a* & 28*b*. It is these interlock disc projections 28*a* & 28*b* that mate with interlock insert depression to form a more secure connection. The two "post-like" structures are compressed towards each other in a resilient manner by the side walls of the "top covered" interlock insert depression. This benefits both alignment and security of the connection.

Figure 4:
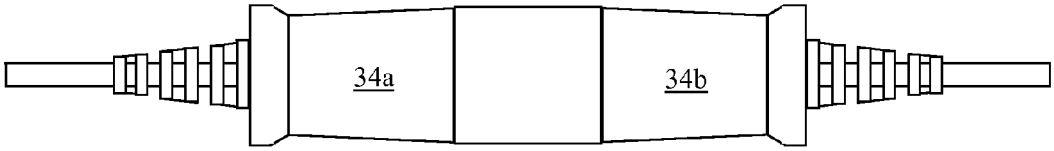
FIG. 4 is a top plan view of two connector halves according to the present invention connected together inline.
Figure 5:
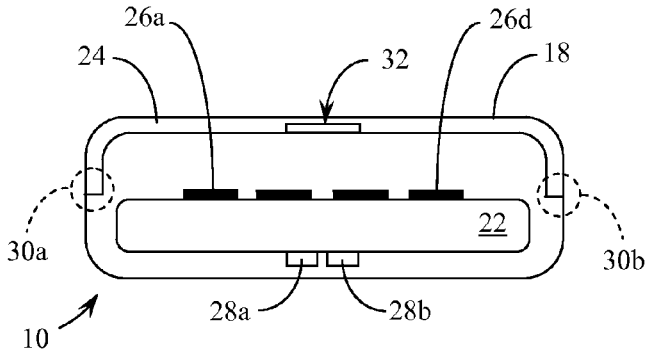
FIG. 5 is an end view of a connector half according to the present invention showing the connector contacts.

FIG. 4 is a top plan view of two connector halves 34*a* & 34*b* according to the present invention connected together inline. FIG. 5 is an end view of a connector half according to the present invention showing the connector contacts. In this end view are shown quick disconnect (QD) wiring connector 10 with connector half interface 18, electrical conductor pads support base 22, and interconnect conductor shroud 24. Parts of the structure of shroud 24 are interlock side hooks 30*a* & 30*b*. The "top covered" interlock insert depression 32 is shown in this end view on the underside of the outer surface of connector half interface 18. Also shown in this view as supported on electrical conductor pads support base 22 are electrical contact pins 26*a*-26*d*. Also shown as positioned on the outer surface of support base 22 are interlock disc projections 28*a* & 28*b*, which as indicated above mate with interlock insert depression 32.

Figure 6:
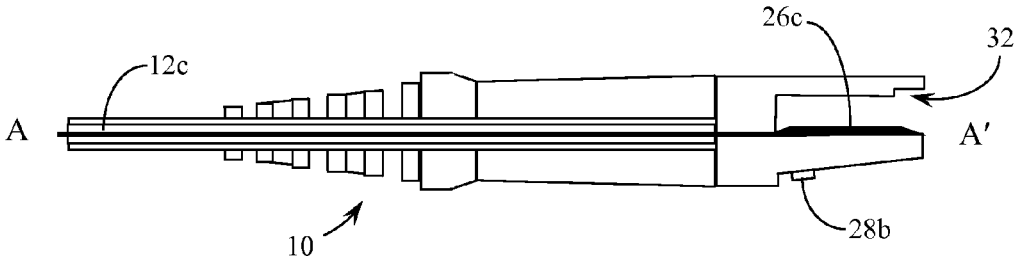
FIG. 6 is a cross-sectional view a connector half according to the present invention viewed along section line A-A' in FIG. 1.

FIG. 6 is a cross-sectional view a connector half according to the present invention viewed along section line A-A' in FIG. 1. In this view conductor 12*c* is shown to extend to electrical contact pin 26*c*. Interlock disc projection 28*b* and interlock insert depression 32 are also shown in this cross-sectional view.

Although the present invention has been described in terms of the foregoing preferred embodiments, this description has been provided by way of explanation only and is not intended to be construed as a limitation of the invention. Those skilled in the art will recognize modifications of various features and structures of the present invention that might accommodate specific electrical cable and connector requirements. As indicated above, the specific number of conductors and the specific size of the cable may be varied. These modifications do not necessarily depart from the spirit and scope of the invention

I claim:

1. A quick disconnect hermaphroditic electrical connector that specifically improves the keyed alignment of two connector ends when joined together and the security of the connection, each half of the hermaphroditic connector being generally identical to each other and each comprising:

a top closed interlock insert depression;

a pair of interlock disc projections positioned so as to align with the interlock insert depression of the mating connector half and to be inserted therein to facilitate secure connection between the connector halves; and sharp angle interlock side hooks positioned on opposing sides of each connector half so as to align with a corresponding side hook of the mating connector half and to be hooked thereon to facilitate secure connection between the connector halves.

* * * * *